US005971235A

United States Patent [19]

Chanek

[11] Patent Number: 5,971,235

[45] Date of Patent: Oct. 26, 1999

[54] GARMENT CREASER

[76] Inventor: Billy R. Chanek, PSC 827 Box 4604, FPO, United Arab Emirates, 09617-4604

[21] Appl. No.: 08/975,075

[22] Filed: Nov. 20, 1997

[51] Int. Cl.[6] ..... A41H 33/00; A41H 1/00

[52] U.S. Cl. ..... 223/37; 33/11; 33/485; 38/144

[58] Field of Search ..... 223/37, 38; 33/11, 33/12, 17 R, 2 A, 485, 484; 38/144

[56] References Cited

U.S. PATENT DOCUMENTS

| | | | |
|---|---|---|---|
| 83,115 | 10/1868 | Wilcox . | |
| 562,276 | 6/1896 | Boyd . | |
| 718,939 | 1/1903 | Pike . | |
| 742,373 | 10/1903 | Alden . | |
| 970,586 | 9/1910 | Whitaker . | |
| 1,220,212 | 3/1917 | Ferris | 33/484 |
| 1,659,739 | 2/1928 | Kuhlman | 33/486 |
| 2,026,768 | 1/1936 | Aronson | 33/485 |
| 2,204,353 | 6/1940 | Fulton | 33/485 |
| 2,818,649 | 1/1958 | Kolthoff et al. | 33/11 |
| 3,216,024 | 11/1965 | Menhart | 2/274 |
| 3,352,466 | 11/1967 | McAllister | 33/492 |
| 3,439,845 | 4/1969 | Lester . | |
| 3,766,613 | 10/1973 | Merfeld . | |
| 4,042,155 | 8/1977 | Sprong . | |
| 4,507,869 | 4/1985 | Stude | 33/485 |
| 5,615,488 | 4/1997 | Brady | 33/484 |

*Primary Examiner*—Bibhu Mohanty
*Attorney, Agent, or Firm*—Richard C. Litman

[57] ABSTRACT

A garment creaser which may be used both to apply new creases to an item of clothing and to freshen preexisting creases. It consists of a wide blade fabricated from metal or a similarly rigid and heat-resistant material with a very slender thickness, and a plurality of semi-circular clips which fit closely over the edges of the blade. An item of clothing is creased therewith by folding it over one of the longitudinal edges of the blade, clipping it in place, and ironing over the edge of the blade. One of the longitudinal edges is equipped with a measuring scale which enables precise measurement of the length of the creases, as well as of their placement relative to other features on the item of clothing.

1 Claim, 3 Drawing Sheets

GARMENT CREASER

BACKGROUND OF THE INVENTION

1. Field of the Invention

The present invention relates generally to devices for use in conjunction with fabrics and garments. More specifically, the present invention relates to a straight-edge blade and clip assembly used as an accessory to ironing to create folds or creases in fabrics and garments.

2. Description of the Related Art

It is well-known that the military requires soldiers to maintain an external appearance which is neat and clean to the utmost degree. Part of the required appearance in many types of military apparel involves the presence of creases at pre-determined locations in various items of clothing. In keeping with the general character of the military dress-code, it is strongly desirable that these creases be of an extremely clean, sharp, and straight character, and that they be located the proper distances relative to one another and relative to other features of the clothing item on which they are present.

The task of ironing creases into clothing can be time-consuming and highly imprecise if the task is undertaken merely with the use of the naked eye to discern the proper lengths and locations of the creases thereon. Thus, a need exists for a device which can aid the process of ironing creases into garments by assuring that the creases themselves are straight and sharp, that they are of the proper length, and that they are in the proper location relative to one another and to other features of the garment. It is, moreover, desirable that a device of this type be easy to use and convenient to store, as military personnel are frequently in a situation where available storage space for personal belongings is extremely limited.

Garment creasers have been the subject of earlier patents. U.S. Pat. No. 562,276, issued to Boyd, discloses a device specifically designed to create front and rear creases in trousers. The device consists of a plurality of boards which are used to sandwich the legs of the trousers in a single stack, and a set of clips to apply pressure to the resultant stack. U.S. Pat. No. 718,939, issued to Pike, describes a similar configuration involving the use of a plurality of boards in conjunction with a pressure clamp which is tightened by means of thumb screws. U.S. Pat. No. 970,586, issued to Whitaker, describes a pair of hingedly connected boards operating on a principle similar to that employed in the two aforementioned patents, but intended to tightly hold together different layers of cloth to facilitate their being whipped-stitched together.

U.S. Pat. No. 3,439,845, issued to Lester, Jr., describes an apparatus for creasing trousers operating on a somewhat different principle from the aforementioned inventions. The device consists of a pair of C-shaped elements whose outer longitudinal edges are of a substantially triangular cross-section, and which are interconnected by means of thumb-screws. The outward-facing apices of these triangles are used to apply pressure along the length of pant-legs on opposite sides thereof by suitable adjustment of the locations of the C-shaped elements relative to one another. The triangularly cross-sectioned edges create creases by the passage of electrical current therethrough to heat them. The creasing effect resulting from this heating process may be augmented by the application of steam to the pants from steam-chambers built into the creasing edges.

A device based on yet another operating principle is disclosed in U.S. Pat. No. 4,042,155, issued to Sprong. This patent discloses an adjustable fabric pleater guide intended for employment in the spacing and forming of pinch pleats in draperies. It consists of a blade-shaped base member having a plurality of fingers perpendicularly attached thereto. Some fingers are permanently affixed; others are variably positionable along the length of the base by means of sliding and are affixed thereto by a nut and bolt combination. By positioning these fingers appropriately and folding the drapery therebetween according to a specific method, it is possible to create a set of evenly spaced pleats therein.

However, none of the aforementioned devices are aptly suited for use by military personnel because they all take up a considerable amount of storage space. Moreover, the majority of these devices are specifically geared to creating lengthy creases in the front and rear sides of pants or along a significant portion of the length of drapes. It is therefore not possible to use them to create creases having shorter, precisely defined lengths, and exact positions relative to other features in a garment. Moreover, the aforementioned devices are altogether difficult to employ in conjunction with any type of garment other than the type for which they were specifically designed.

The prior art also discloses some devices differing significantly from the invention to be claimed herein as regards function, but bearing more structural similarity thereto than the previously cited references. These include U.S. Pat. No. 83,115, issued to Wilcox, which discloses a combination paper cutter and ruler; and U.S. Pat. No. 742,373, issued to Alden, which describes a combination envelope opener, folder, and ruler. Both inventions lack a structural feature which, as described below, is essential to the structure and function of the present invention, namely, the presence of a plurality of clips which closely fit over the edges of the ruler. Moreover, neither of the two aforementioned inventions is specifically constructed from heat-resistant material, rendering them both entirely unsuited to the purposes fulfilled by the invention to be claimed in the present specification.

Finally, U.S. Pat. No. 3,766,613, describes a garment clip bearing similarities in some respects to the clips comprising part of the present invention. The facing sides of that particular clip are designed to exert pressure against one another, however, and differ in this respect from the clips comprising part of the present invention.

For these reasons, none of the above inventions and patents, taken either singularly or in combination, is seen to describe the present invention as claimed.

SUMMARY OF THE INVENTION

The present invention comprises a clothing creaser, which may be used both to apply new creases to an item of clothing, or to freshen preexisting creases. It consists of a single blade and a plurality of clips. The blade has a relatively wide face but is of a very slender thickness, and is constructed of metal or a similarly rigid and heat-resistant material. The associated clips are of a semi-circular shape and fit closely over the edges of the blade. One creases an item of clothing with this combination of elements by folding it over one of the longitudinal edges of the blade, clipping it in place thereon with the clips, and ironing over the edge of the blade. One of the longitudinal edges is equipped with a measuring scale which enables precise measurement of the length of the creases, as well as of their placement relative to other features on the item of clothing.

Accordingly, it is a principal object of the invention to provide a device which may be use to create new creases or freshen pre-existing creases in items of clothing.

It is another object of the invention to provide a device enabling the creation of creases which are extremely straight and which have a sharp and well-defined character.

It is a further object of the invention to provide a device of the aforementioned type which enables precise control over the length and location of the creases.

It is an object of the invention to provide improved elements and arrangements thereof in a clothing creaser for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
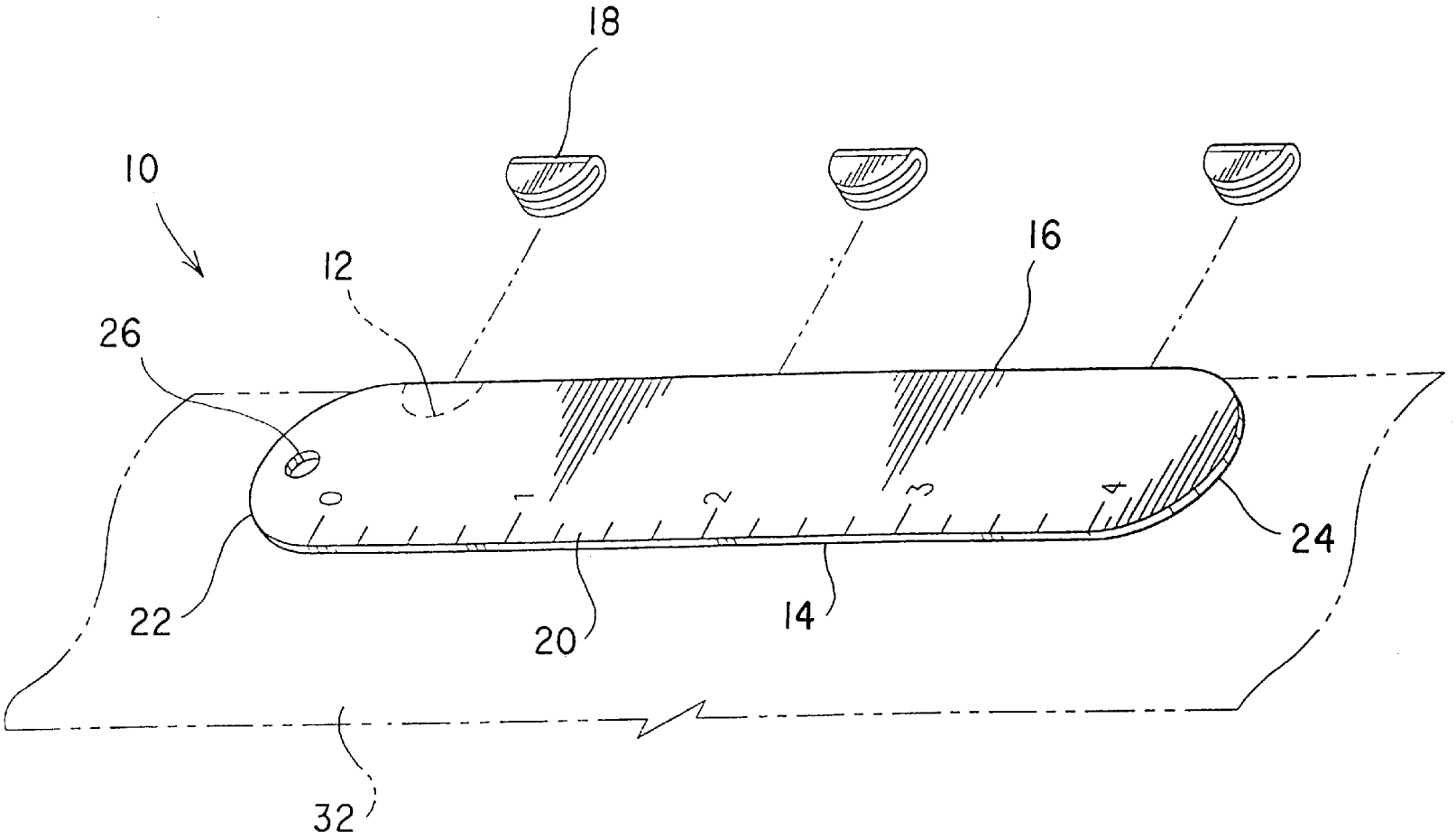
FIG. 1 is a perspective view of a garment creaser according to the present invention.

The present invention comprises a garment creaser, designated generally by the reference numeral 10, which may be used both to apply new creases to an item of clothing, or to freshen preexisting creases. Referring first to FIG. 1, the main component of the device is a wide blade 12 of a very slender thickness, and with parallel longitudinal edges 14 and 16. The blade 12 is fabricated of a sturdy metal or some other relatively rigid and heat-resistant material. The device further includes a plurality of semi-circular clips 18 which fit closely over the edges 14 and 16 of the blade 12. One of the longitudinal edges 14 is equipped with a measuring scale 20 which enables precise measurement both of the lengths of the creases and of their locations relative to other features of the garment.

The preferred embodiment of the device includes several additional features as well. First, the ends 22 and 24 of the blade 12 are rounded to prevent the blade 12 from snagging with the material of the clothing item when in use. Second, one of the ends 22 defines a hole 26 enabling easy storage of the device by means of hanging from a nail or the like.

Figure 2:
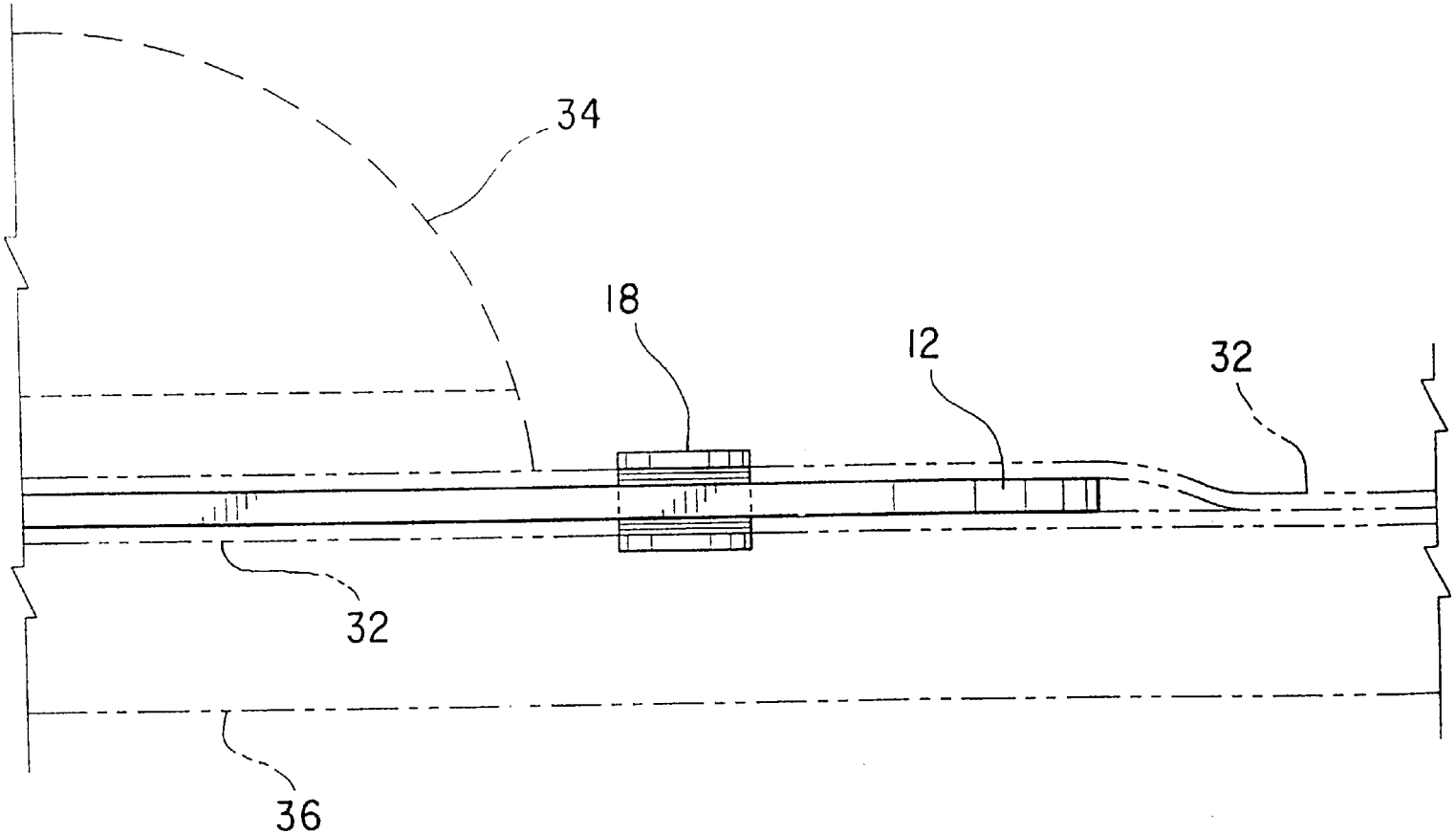
FIG. 2 is a side-elevational close-up view of the garment creaser in use with a garment, pressing iron, and ironing board shown in phantom lines.
Figure 3:
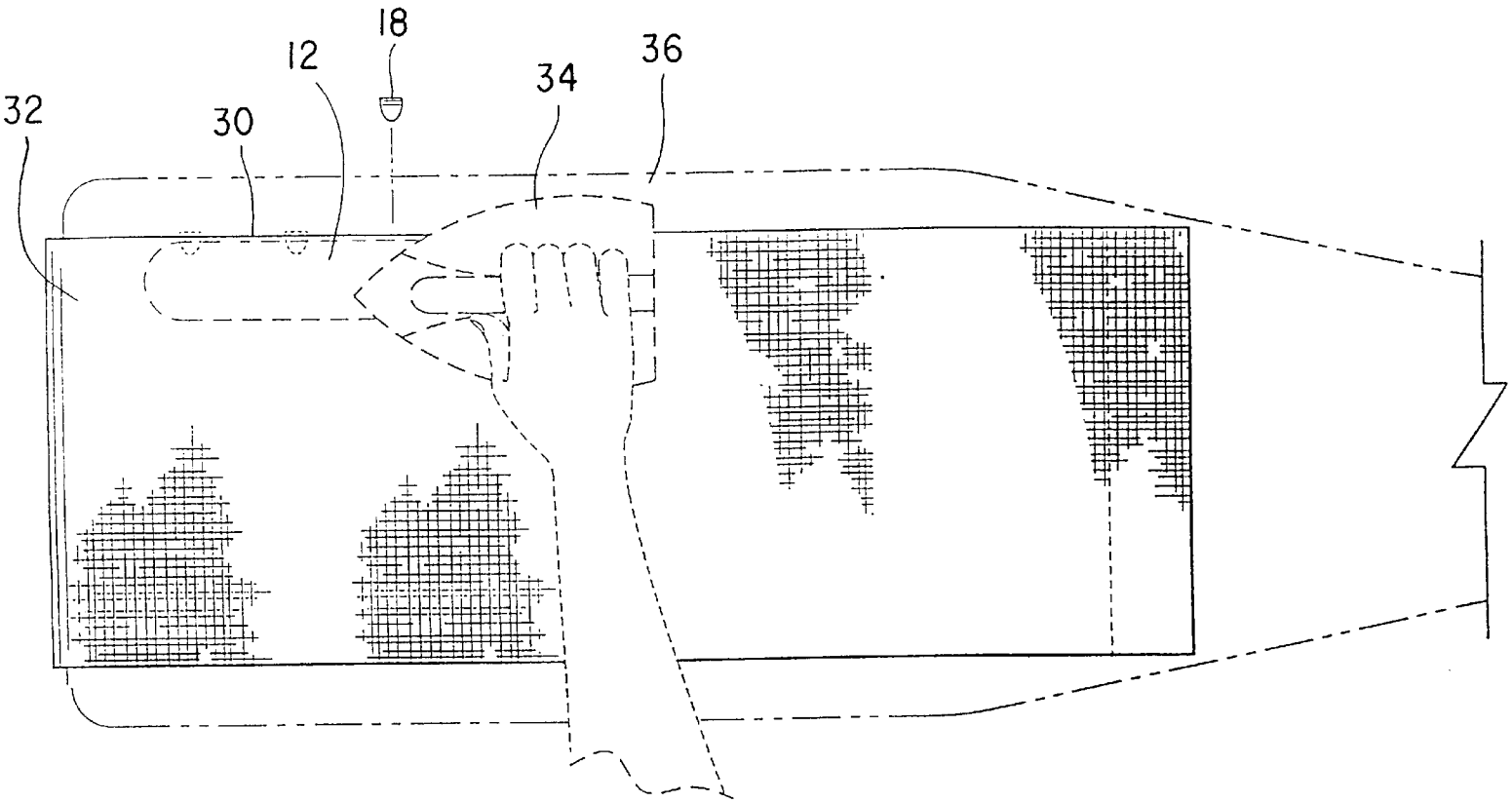
FIG. 3 is a diagrammatic plan view of the garment creaser in use with a garment, pressing iron, and ironing board.

The method according to which the creaser is best employed to create creases may be understood with the aid of FIGS. 2 and 3. First, one uses the ruled side 14 of the blade 12 to measure the locations of the two end positions of the desired crease (not shown) on the folded location 30 of clothing item 32. If desired, one may mark these end positions with water-soluble chalk. Next, one inserts the blade 12 against the inside of fold 30 so that one of the edges 14 or 16 on the blade 12 is aligned with the marked locations. After pulling the clothing item 32 taut over the blade edge 14 or 16, one attaches as many clips 18 as necessary over the edge of the blade 12 to hold the clothing item 32 firmly in place thereon. At this point, it is possible to use starch, a pressing iron 34, and an ironing board 36 to apply the initial crease.

Following removal of the blade and clips, one may sharpen the definition of the crease by ironing over that location a second time. If additional creases are needed, this process may be repeated. When finished, the blade 12 and clips 18 may be conveniently stored by clipping the latter to the blade prior to storage.

It is to be understood that the present invention is not limited to the embodiment described above, but encompasses any and all embodiments within the scope of the following claims.

I claim:

1. Method of using a garment creaser, said method comprising:

providing a pressing iron, a garment, and water-soluble chalk;

providing a garment creaser, said garment creaser comprising a blade fabricated from rigid, heat-resistant material, said blade having at least one straight longitudinal edge, said straight longitudinal edge further including ruled markings, and a plurality of clips having first and second arms, said clips being fabricated from rigid, heat-resistant material, and fitting closely over said at least one straight longitudinal edge;

measuring the locations of the two end positions of a crease on the garment using said ruled markings;

marking the two end positions with the water-soluble chalk;

inserting said blade under the garment and folding the garment over said longitudinal edge such that said edge aligns with the two end positions;

pulling the garment taut over said longitudinal edge;

attaching said clips over said longitudinal edge to hold the fabric firmly in place thereon;

using the pressing iron to apply an initial crease;

removing said blade and said clips from the garment; and using the pressing iron a second time to sharpen the definition of the initial crease.

* * * * *